US005410831A

United States Patent [19]

Felk

[11] Patent Number: 5,410,831

[45] Date of Patent: May 2, 1995

[54] EXTRACTORS FOR AUTOMATIC PISTOLS

[76] Inventor: Edward K. Felk, 126 Skye Pt Rd, Coal Point NSW 2283, Australia

[21] Appl. No.: 293,458

[22] Filed: Aug. 22, 1994

[51] Int. Cl.[6] ..... F41A 9/53; F41A 15/10

[52] U.S. Cl. ..... 42/25; 42/1.05

[58] Field of Search ..... 42/1.05, 25

[56] References Cited

U.S. PATENT DOCUMENTS 2,100,273 11/1937 Skandera ..... 42/1.05
2,850,827 9/1958 Luciani ..... 42/1.05

FOREIGN PATENT DOCUMENTS 271863 3/1914 Germany .
333248 2/1921 Germany .
437957 12/1926 Germany .

*Primary Examiner*—Charles T. Jordan
*Assistant Examiner*—Christopher Keith Montgomery

[57] ABSTRACT

An extractor as fitted to an automatic pistol comprising: a frame; a slide with a breech block at the rear which slides on the frame over a barrel to form a cartridge receiving chamber; an extractor having a claw provided with an apex so that when a cartridge is in the chamber said extractor protrudes out of the breech block exposing a coloured dot provided on the extractor to indicate that the chamber is loaded and improve the ejection of a cartridge and the function of the pistol.

2 Claims, 1 Drawing Sheet

EXTRACTORS FOR AUTOMATIC PISTOLS

FIELD OF THE INVENTION

This invention relates to extractors as fitted to automatic pistons of the type which automatically eject a spent cartridge and chamber a new one after each shot.

BACKGROUND OF THE INVENTION

It is known that automatic pistols require many parts to manufacture them and are prone to accidental discharge thus requiring as many safety features as possible to make the pistol safe to handle.

OBJECT OF THIS INVENTION

It is therefore the object of this invention to provide an added safety without adding any more parts to the pistols or adding to the cost to manufacture them.

SUMMARY OF THIS INVENTION

This object is attained with a chamber loaded indicating extractor fitted to an automatic pistol comprising a frame, a barrel with a cartridge receiving rear and a slide with a breech block in the rear which slides on the frame and engages over the barrel to form a cartridge chamber. The extractor embodies a shaped claw to form an apex on its blade so that when a cartridge is in the chamber the apex of the claw engages the highest point of the cartridge's extraction groove, thereby forcing the extractor sideways in the breech block to protrude out of the side of said breech block and expose a brightly coloured dot provided on the extractor which is clearly visible, indicating that the chamber is loaded. The coloured dot is not visible when the chamber is empty. According to this invention an extra safety is provided to a pistol or rifle without the added burden of manufacturing extra parts or the extra cost it would involve.

SPECIFIC DESCRIPTION

Figure 1:
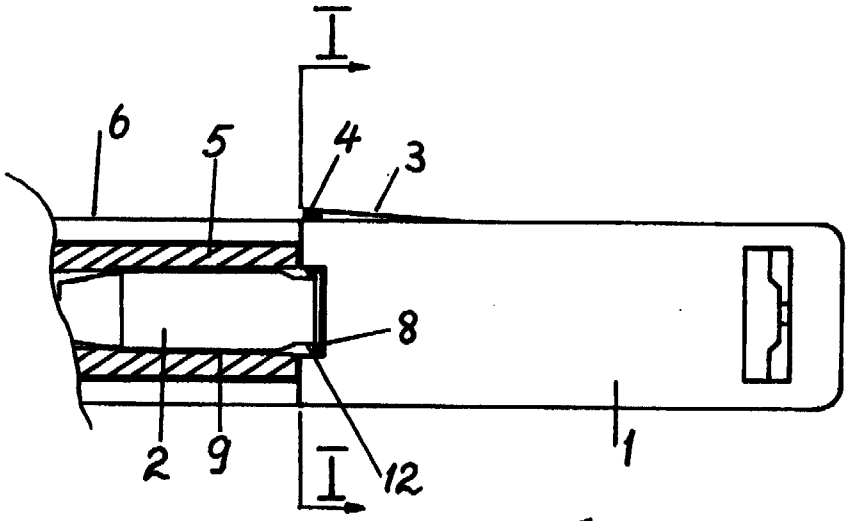
FIG. 1 is a top view of a loaded chamber formed by a breech block engaged over a barrel.
Figure 4:
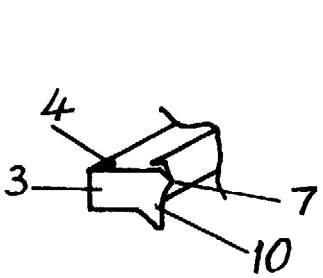
FIG. 4 shows a typical extractor with a coloured dot and an apex included.
Figure 3:
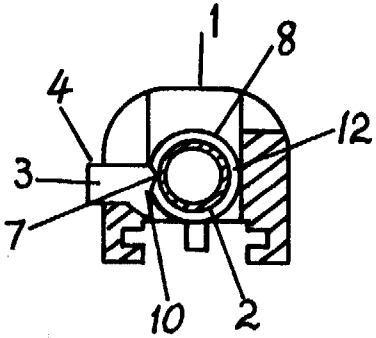
FIG. 3 shows the face of the breech block through section line I with the cartridge loaded.
Figure 2:
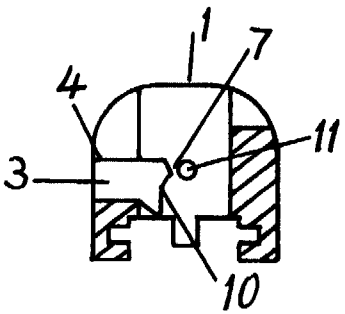
FIG. 2 shows the face of the breech block through section line I without the cartridge loaded.

FIG. 1 shows the slide (6) with the breech block engaging over a barrel (5) forming a cartridge chamber (9) with a cartridge (2) loaded in said chamber (9). When the cartridge (2) is in the chamber (9) the extractor (3) is forced sideways from the breech block (1).

This is achieved by providing an apex (7) on the claw (10) of the extractor (3), preferably directly in line with the firing pin hole (11) so when the cartridge (2) is being loaded it connects the low part of the claw (10) first and as it is being forced up to be fully loaded it forces the extractor (3) sideways as the cartridge (2) engages the apex (7) of the claw (10). As the extractor (3) is forced out sideways from the breech block (1) it exposes a brightly coloured dot (4) which is provided on said extractor (3), which is clearly visible and indicates that the chamber (9) is loaded. The lower section of the claw (10) below the apex (7) is shaped to be the same radius (12) as the cartridge (2). This also improves the directional ejection of said cartridge (2). As the barrel (5) drops, after firing the pistol, it positions the cartridge (2) in the lower portion of the claw (10) which embraces the cartridge (2) much better around its radius making ejection more positive thereby improving the function of the pistol. This invention is not limited to automatic pistols only, the same can be achieved with rifles and the like. In this invention no extra parts are required to manufacture the chamber loaded indicator, therefore the manufacture of the pistol is easier to achieve adding no extra cost and providing a safer pistol to handle.

I claim:

1. An extractor as fitted to an automatic pistol comprising:

a frame and a slide with a breech block at the rear and slideable on the frame;

a barrel with the slide over said barrel forming a cartridge chamber;

and the extractor with a claw and a coloured dot embodied in said extractor, said extractor positioned at the front face and on the side of the breech block for extracting a cartridge, said extractor is provided with an apex and a radius on its claw so that when the cartridge is being loaded into the chamber the extractor is being forced out to the side to protrude out of the breech block when the cartridge is fully loaded in the chamber, the apex of the claw engaging a cartridge with a groove, said groove having a high point thereby exposing the coloured dot, which is clearly visible and indicating that the chamber is loaded.

2. The extractor defined in claim 1 wherein the claw of the extractor, having an apex and a radius provided, helps in the extraction of the cartridge when the pistol has been fired and the barrel and the cartridge drops down thereby positioning said cartridge below the apex in the claw allowing the cartridge to be embraced in the radius of said claw thereby improving the grip on the cartridge and improving the directional ejection of the cartridge and function of the pistol.

* * * * *